US008448539B2

(12) United States Patent
Chen

(10) Patent No.: US 8,448,539 B2
(45) Date of Patent: May 28, 2013

(54) SPRING OPERATION DEVICE AND METHOD FOR ASSEMBLING THE SAME AND SWITCHING DEVICE

(75) Inventor: De Zhou Chen, Wuxi (CN)

(73) Assignee: Siemens Aktiengesellschaft, Munich (DE)

( * ) Notice: Subject to any disclaimer, the term of this patent is extended or adjusted under 35 U.S.C. 154(b) by 454 days.

(21) Appl. No.: 12/868,998

(22) Filed: Aug. 26, 2010

(65) Prior Publication Data

US 2011/0048148 A1 Mar. 3, 2011

(30) Foreign Application Priority Data

Aug. 28, 2009 (CN) ..... 2009 1 0167593

(51) Int. Cl.

| | |
|---|---|
| ***G05G 5/06*** | (2006.01) |
| ***H01H 5/00*** | (2006.01) |
| ***H01H 5/08*** | (2006.01) |
| ***H01H 23/00*** | (2006.01) |

(52) U.S. Cl.
USPC ..... 74/532; 200/400; 200/401; 200/438

(58) Field of Classification Search
USPC ..... 200/400, 401, 431, 437, 438; 74/520, 74/527, 532
See application file for complete search history.

(56) References Cited

U.S. PATENT DOCUMENTS

| | | | | | |
|---|---|---|---|---|---|
| 1,964,561 | A * | 6/1934 | Douglas | 200/6 A |
| 4,490,591 | A * | 12/1984 | Page | 200/437 |
| 4,697,053 | A * | 9/1987 | Lockard | 200/437 |
| 4,814,554 | A * | 3/1989 | Magiera | 200/6 R |
| 6,903,293 | B2 * | 6/2005 | Sasaki | 200/339 |
| 7,790,997 | B2 | 9/2010 | Girodet et al. | |
| 2007/0131528 | A1 | 6/2007 | Mattlar et al. | |
| 2009/0120907 | A1 | 5/2009 | Girodet et al. | |

FOREIGN PATENT DOCUMENTS

| | | | |
|---|---|---|---|
| CN | 2775815 | Y | 4/2006 |
| CN | 1791955 | A | 6/2006 |
| CN | 1914703 | A | 2/2007 |
| CN | 101436486 | A | 5/2009 |
| EP | 1873799 | A1 * | 1/2008 |
| WO | WO 2004/109734 | | 12/2004 |
| WO | WO 2005076302 | A1 | 8/2005 |

* cited by examiner

*Primary Examiner* — Phillip A Johnson
(74) *Attorney, Agent, or Firm* — Harness, Dickey & Pierce, P.L.C.

(57) ABSTRACT

A spring operation device and a method for assembling the same are disclosed. A switching device including the spring operation device is also disclosed. In the spring operation device disclosed in at least one embodiment of the present invention, by way of a smooth corrugated protuberance, the protuberance can push the operation mechanism of the spring operation device to rotate accurately and efficiently under the effect of a spring at the moment when the spring's energy storing process is completed, so as to accomplish the release of energy.

18 Claims, 5 Drawing Sheets

SPRING OPERATION DEVICE AND METHOD FOR ASSEMBLING THE SAME AND SWITCHING DEVICE

PRIORITY STATEMENT

The present application hereby claims priority under 35 U.S.C. §119 on Chinese patent application number CN 200910167593.X filed Aug. 28, 2009, the entire contents of which are hereby incorporated herein by reference.

FIELD

At least one embodiment of the present invention generally relates to the field of mechanics and, in particular, to a spring operation device and/or a method for assembling the same, and at least one embodiment of the present invention also generally relates to a switching device comprising the spring operation device.

BACKGROUND

A switching device 2' is shown in FIG. 1 which comprises a frame and a spring device 1', in which an actuator is adapted to rotate and drive the main shaft of the switching device and is rotatable around a rotation shaft, with the spring device 1' being installed, and the actuator having a "0" position, an "I" position and a first dead point located between the "0" position and the "I" position, wherein the "I" position is positioned at a given angle relative to the "0" position along a first direction. The actuator further has a test position, which is positioned at a preset angle relative to the "0" position along a second direction, and the second direction is opposite to the first direction.

SUMMARY

The present inventor has found that in this solution, the spring device 1' is generally a hard spring, and the size of the switch is limited, therefore the spring 1' cannot be compressed conveniently for storing energy, therefore it is very inconvenient to directly assemble the spring 1' into the switch 2'.

In at least one embodiment of the present invention, a spring operation device and/or a method is provided for assembling the same, and/or a switch is provided to reduce or avoid the problem mentioned above.

At least one embodiment of the present invention provides a spring operation device comprising a bracket with a bottom wall and a side wall, and a spring with one end thereof fixed on said bottom wall, the device further comprising a sliding block, with the sliding block contacting the other end of said spring when in the installed state, and moving, under an external force, basically linearly on said side wall along the placement direction of the spring, and an operation mechanism with a contact shaft and a support shaft, with the operation mechanism being placed on said bracket via said support shaft and placed on said sliding block via said contact shaft, wherein said sliding block has an extending corrugated protuberance along a direction basically horizontally perpendicular to said support shaft, and said contact shaft moves in close contact with said protuberance under the external force.

Preferably, the corrugated protuberance is strip-shaped, and, preferably, the corrugated protuberance is basically symmetrically arranged about the symmetry axis of the bracket.

Preferably, the side wall has an opening for holding the support shaft.

Preferably, the contact shaft is basically tangentially in contact with the sliding block.

Preferably, the contact shaft is a roller.

At least one embodiment of the present invention further discloses a switching device comprising the above spring operation device.

At least one embodiment of the present invention further discloses a method for assembling a spring operation device, comprising the following steps of:

providing a bracket with a bottom wall and a side wall, and fixing one end of a spring onto the bottom wall, and providing a sliding block, with the sliding block contacting the other end of the spring, and with the sliding block being capable of reciprocating basically linearly on the side wall along the placement direction of the spring, and providing an operation mechanism with a contact shaft and a support shaft, with the contact shaft being placed on the sliding block and placed on the bracket via the support shaft, wherein the sliding block has an extending corrugated protuberance in a direction basically horizontally perpendicular to the support shaft, and the contact shaft moves in close contact with the sliding block under an external force.

Since there is a smooth corrugated protuberance on the sliding block of the spring operation device, which can push the operation mechanism to rotate accurately and efficiently under the effect of the spring at the moment when the spring's energy storing process is completed, this accomplishes the release of energy. In addition, the spring with a large compressing force can be conveniently pre-assembled in the sub-assembly outside of the product prior to the general assembly of the product, so that it realizes a convenient assembly of the spring with a large compressing force.

BRIEF DESCRIPTION OF THE DRAWINGS

The following drawings are intended only for illustrative description and explanation of embodiments of the present invention and are not to limit the scope of the present invention. In the drawings.

DETAILED DESCRIPTION OF THE EXAMPLE EMBODIMENTS

Figure 1:
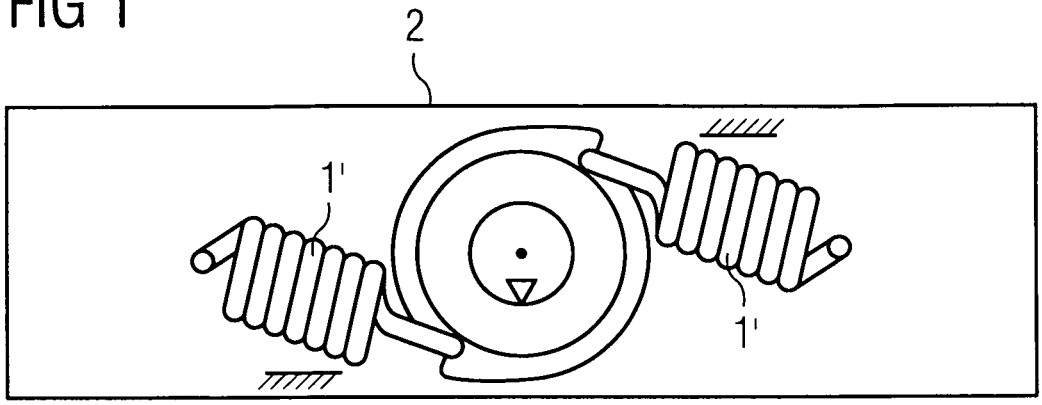
FIG. 1 is a schematic diagram of a switch in the prior art.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In order to understand more clearly the technical features, objects and effects of the present invention, particular embodiments of the present invention are described herein with reference to the accompanying drawings.

Figure 2:
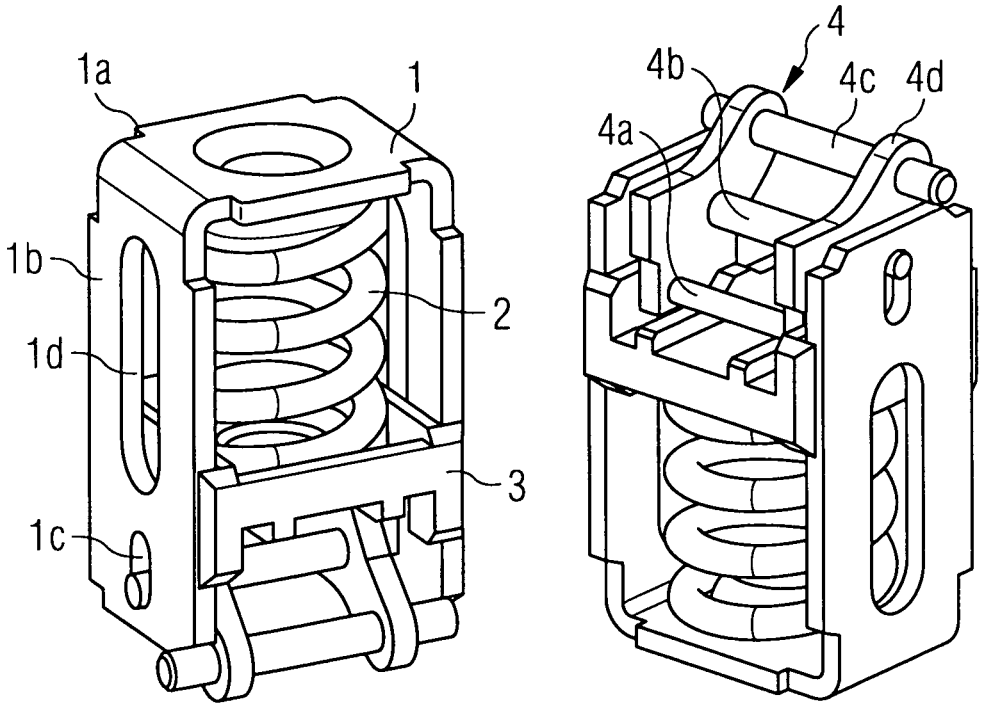
FIG. 2 is a perspective schematic diagram of a spring operation device in the embodiment of the present invention.
Figure 3:
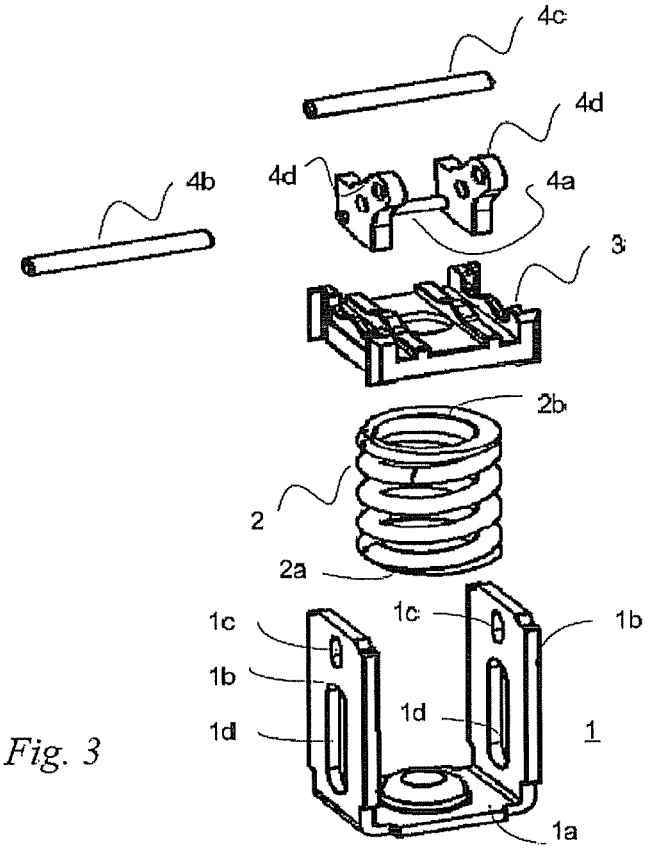
FIG. 3 is an exploded schematic diagram of the spring operation device in the embodiment of the present invention.

As shown in FIGS. 2 and 3, a spring operation device comprises a bracket 1 made of, for example, steel plates and the like, which has a bottom wall 1*a* and a side wall 1*b*, and the bracket 1 can be roughly a box with two symmetrical side walls or a cylindrical bracket. In this case an opening 1*c* is provided symmetrically on the bracket side walls 1*b* for holding components such as shafts and the like, and there can also be an opening 1*d* under the opening 1*c* via which the general condition of the interior of the bracket 1 is visible. The end of the bracket 1 opposite the bottom wall 1*a* is not closed, so that it can be used to place other components. The bottom wall 1*a* and the side walls 1*b* form a basically empty cavity part, which can be used for holding other components, e.g. for fixing one end of a spring on the bottom wall 1*a* and holding it in the empty cavity so formed.

A spring 2 is placed on the bottom wall 1*a* by way of, for example, insertion, and the spring 2 can be made of, for example, spring steel wires and the like, the extension direction of the spring 2 being basically perpendicular to the bottom wall 1*a* and facing the opening opposite to the bottom wall 1*a*, and preferably one end 2*a* of the spring 2 is placed at the center of the bottom wall 1*a* such that the spring 2 is basically symmetric about the symmetry axis of the bracket 1. Of course, there can be one spring here, but there can also be a plurality of springs of the same length in parallel or a plurality of springs in series.

The device further comprises a sliding block 3 made of, for example, steel and the like, which moves basically linearly on the side wall 1*b* along the placement direction of the spring 2 under an external force and contacts the other end 2*b* of the spring 2 when in the installed state, and the sliding block 3 can move relative to the side wall 1*b* both via the grooves on the side wall 1*b*, and via its own slots.

Figure 4A:
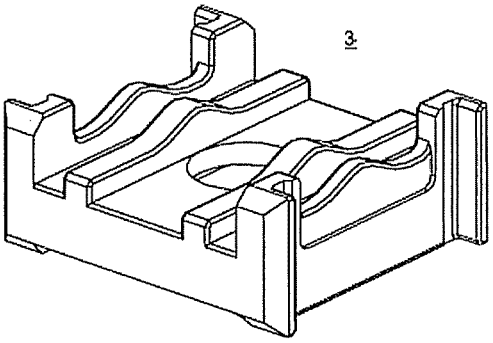
FIG. 4*a* is a schematic diagram of a sliding block in the embodiment of the present invention.
Figure 4B:
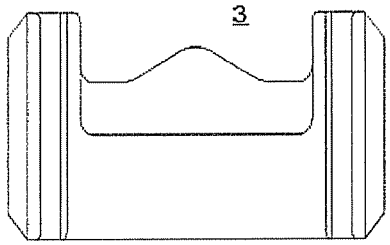
FIG. 4*b* is a schematic diagram of another sliding block in the embodiment of the present invention.

One face of the sliding block 3 is in contact with one end 2*b* of the spring to position the spring into the sliding block 3, and on the other face there is an extending corrugated protuberance, whose extension direction is basically parallel (in top view) to the planar surface of the side wall 1*b*; and the profile of the cross section of the protuberance is formed by a smooth curve bulging outward, and its cross section can be U-shaped, V-shaped, S-shaped, Ω-shaped or arc-shaped. The corrugated protuberance can be strip-shaped and basically symmetric about the symmetry axis of the bracket, for example, there can be a plurality of protuberances arranged lengthwise in parallel as shown in FIG. 4*a*, or there can be one protuberance (as shown in FIG. 4*b*), and of course the protuberance can be asymmetric in the direction of the symmetry axis of the bracket perpendicular to the extension direction, but basically symmetric in the direction of the symmetry axis of the bracket parallel to the extension direction.

Above the sliding block 3 there is an operation mechanism 4 made of, for example, steel plates and the like, comprising a contact shaft 4*a*, a support shaft 4*b* and two rocker arms 4*d* basically symmetrically arranged along the extension direction of the corrugated protuberance of the sliding block 3, in which the support shaft 4*b* is placed into the bracket 1 via the opening 1*c* of the bracket 1, crossing the side walls 1*b* of the bracket 1 and basically horizontally perpendicular to the extension direction of the corrugated protuberance of the sliding block 3, while the contact shaft 4*a* is in contact with the sliding block 3 basically tangentially, and the tangent direction is basically perpendicular to the extension direction of the corrugated protuberance and basically parallel to the axial direction of the support shaft 4*b*. For example, the contact shaft 4*a* can be a basically circular shaft component. The operation mechanism 4 can further have an operation part 4*c*, which can be a shaft passing through the rocker arms 4*d* and being placed transversely on the side walls 1*b* of the bracket 1 via its extending parts at both ends, and the operation part 4*c* can be used to apply force when operating the operation mechanism 4.

The operation principles of the spring operation device are described in detail below with reference to the accompanying drawings.

When applying a force via the operation part 4*c*, the operation mechanism 4 can rotate about the shaft because the support shaft 4*b* is placed in the bracket 1.

Figure 5:
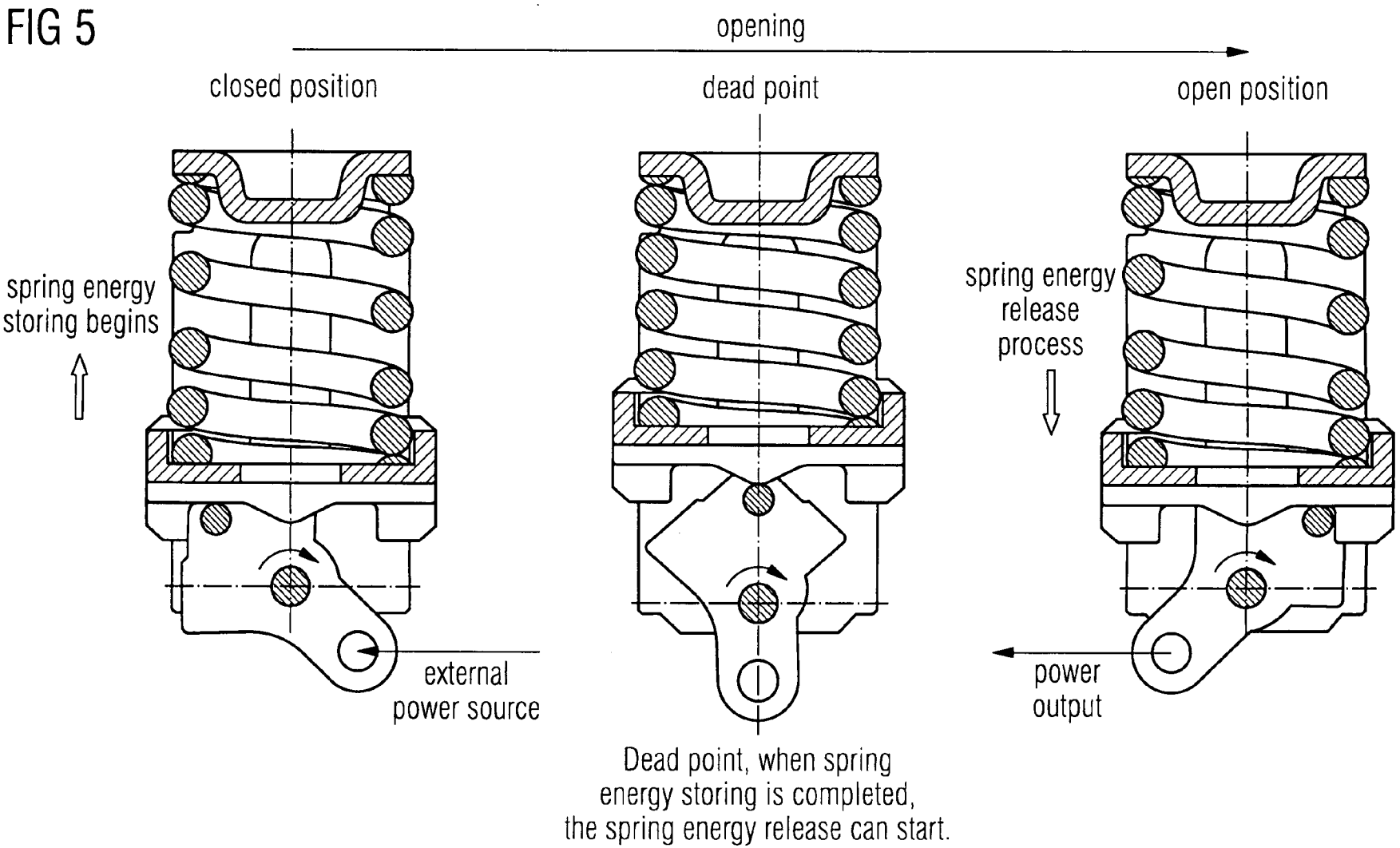
FIG. 5 is a schematic diagram of the opening process of the spring operation device in the embodiment of the present invention.

First, the opening process will be explained, i.e. the process from spring energy storing to spring energy release. As shown in FIG. 5, during this process, the contact shaft of the operation mechanism will first approach the top point of the protuberance, and then move away from the top point of the protuberance.

Figure 6:
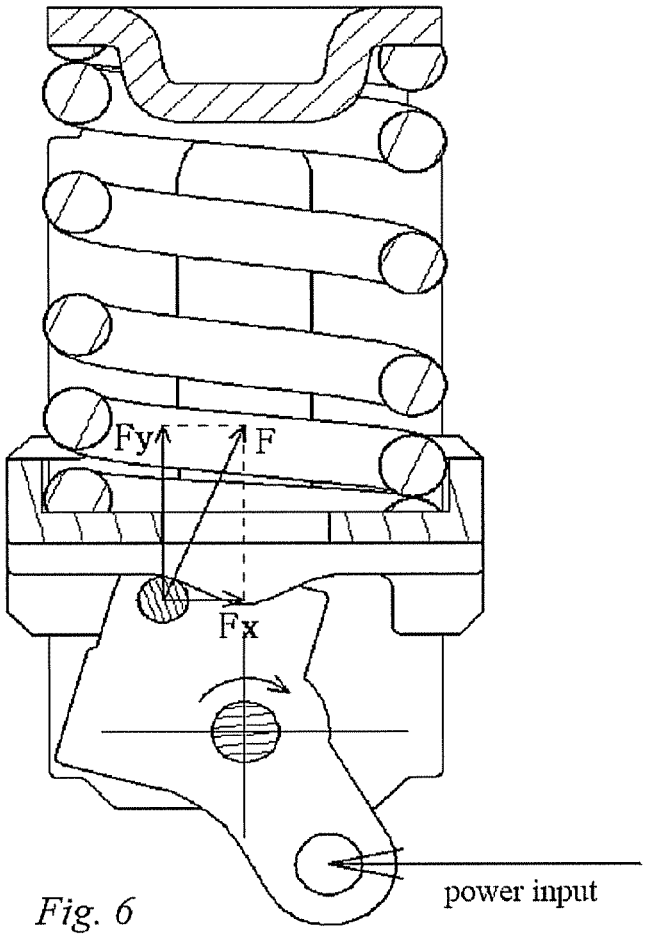
FIG. 6 is an exploded schematic diagram of the force exerted on a contact shaft in the opening process of the spring operation device in the embodiment of the present invention.

As shown in FIG. 6, when a power source is applied to the operation part of the operation mechanism, the contact shaft 4*a* will move in close contact with the sliding block 3 along an opposite direction due to the support of the support shaft 4*b*, at the same time a force F perpendicular to the tangent is generated at the contact point on the protuberance part of the sliding block, which can be divided into two mutually perpendicular forces, with one force FX parallel to the externally applied force, and the other force FY perpendicular to the force FX and parallel to the placement direction of the spring, that is to say, a compressing force FY is generated onto the spring 2 and it continuously compresses the spring 2 by compressing the sliding block 3. FY continuously decreases as the corrugated protuberance rises continuously, up to the upper limit of the protuberance, when F=FX, FY is reduced to 0, and a dead point is reached, then the spring energy storing process is completed, and the stored energy is to be released.

When applying force continuously to the operation mechanism 4, since the corrugated protuberance no longer blocks the movement of the contact shaft 4*a*, the compressing force on the spring 2 no longer exists, and the stored energy of the spring 2 is continuously released, then the spring 2 pushes the sliding block 3 to a complete recovery, thus completing the switch opening process.

Figure 7:
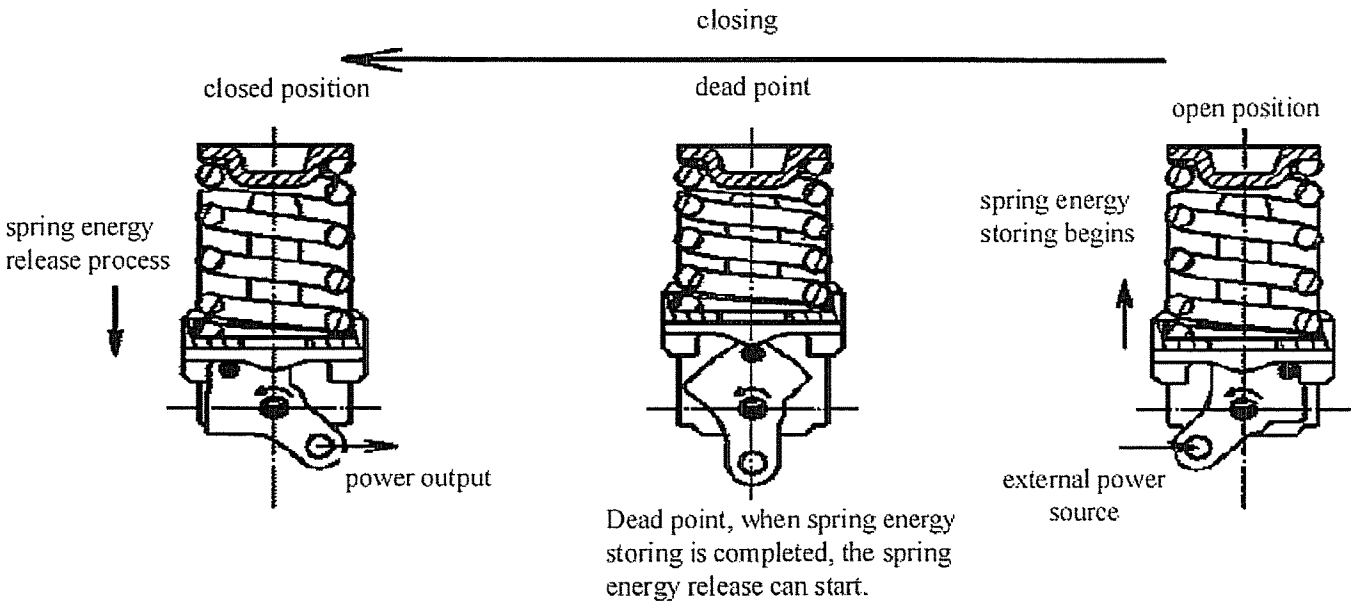
FIG. 7 is a schematic diagram of the closing process of the spring operation device in the embodiment of the present invention.

As shown in FIG. 7, the closing process is similar to the opening process and is merely the reversed process of the opening process.

The embodiments of the present invention further provide a switching device comprising the spring operation device as described in the above embodiments.

The embodiments of the present invention further provide a method for assembling a spring operation device with which the spring operation device provided in the above described embodiments can be assembled.

In the method, it is necessary to provide a bracket with a bottom wall and a side wall, with one end of a spring fixed on the bottom wall of the bracket; to provide a sliding block, with the sliding block contacting and fixed on the other end of the spring for reciprocating basically linearly on the side wall of the bracket along the placement direction of the spring; and to provide an operation mechanism with a contact shaft and a support shaft, with the contact shaft of the operation mechanism placed on the sliding block, and placed on the bracket via the support shaft.

In this case, the sliding block has an extending corrugated protuberance along a direction basically horizontally perpendicular to the support shaft of the operation mechanism, and the contact shaft of the operation mechanism can move in close contact with the sliding block under an external force.

An advantage of at least one embodiments of the present invention is that since there is a smooth corrugated protuberance on the sliding block, the protuberance can push the operation mechanism to rotate accurately and efficiently under the effect of the spring at the moment when the spring's energy storing process is completed, so as to accomplish the release of energy. Another advantage of at least one embodiments of the present invention is that a spring with a large compressing force can be conveniently pre-assembled in a sub-assembly outside of the product prior to the general assembly of the product, so as to realize the convenient assembly of the spring with a large compressing force.

It should be understood by those skilled in the art that although the present invention is described by way of a plurality of embodiments, each of the embodiments does not include only one independent technical solution. The descriptions in the specification are only for clarification, and those skilled in the art should take the specification as a whole for understanding and take the technical solutions concerned in each of the embodiments as being capable of being mutually combined to form various embodiments, so as to understand the protective scope of the present invention.

The description above is only example particular embodiments of the present invention and it is not to limit the scope of the present invention. Any equivalent changes, modifications and combinations without departing from the spirit and the principle of the present invention by those skilled in the art should belong to the protective scope of the present invention.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spring operation device, comprising:

a bracket including a bottom wall and a side wall;

a spring, one end of the spring being fixed on said bottom wall;

a sliding block, contacting another end of said spring when in an installed state, and moving, under an external force, basically linearly on said side wall along a placement direction of the spring; and an operation mechanism including a contact shaft and a support shaft, the operation mechanism being placed on said bracket via said support shaft and placed on said sliding block via said contact shaft, wherein said sliding block includes an extending corrugated protuberance along a direction basically horizontally perpendicular to said support shaft, and wherein said contact shaft moves in close contact with said protuberance under the external force.

2. The spring operation device as claimed in claim 1, wherein said corrugated protuberance is strip-shaped.

3. The spring operation device as claimed in claim 1, wherein said corrugated protuberance is basically symmetrically arranged about the symmetry axis of said bracket.

4. The spring operation device as claimed in claim 1, wherein said side wall includes an opening for holding said support shaft.

5. The spring operation device as claimed in claim 1, wherein said contact shaft is basically tangentially in contact with said sliding block.

6. The spring operation device as claimed in claim 1, wherein said contact shaft is a roller.

7. A switching device, comprising the spring operation device as claimed in claim 1.

8. A method for assembling a spring operation device, comprising:

providing a bracket with a bottom wall and a side wall; fixing one end of a spring onto the bottom wall;

providing a sliding block, the sliding block contacting another end of the spring, the sliding block being capable of reciprocating basically linearly on the side wall along a placement direction of the spring; and providing an operation mechanism including a contact shaft and a support shaft, the contact shaft being placed on the sliding block and placed on the bracket via said support shaft, wherein said sliding block includes an extending corrugated protuberance in a direction basically horizontally perpendicular to the support shaft, and the contact shaft moves in close contact with the sliding block under an external force.

9. The spring operation device as claimed in claim 2, wherein said side wall includes an opening for holding said support shaft.

10. The spring operation device as claimed in claim 2, wherein said contact shaft is basically tangentially in contact with said sliding block.

11. The spring operation device as claimed in claim 2, wherein said contact shaft is a roller.

12. A switching device, comprising the spring operation device as claimed in claim 2.

13. The spring operation device as claimed in claim 3, wherein said side wall includes an opening for holding said support shaft.

14. The spring operation device as claimed in claim 3, wherein said contact shaft is basically tangentially in contact with said sliding block.

15. The spring operation device as claimed in claim 3, wherein said contact shaft is a roller.

16. A switching device, comprising the spring operation device as claimed in claim 3.

17. A switching device, comprising the spring operation device as claimed in claim 2.

18. A switching device, comprising the spring operation device as claimed in claim 3.

* * * * *